United States Patent [19]

Kleiner

[11] 4,428,404

[45] Jan. 31, 1984

[54] PICK-FINDING MECHANISM WITH CREEPING SPEED

[75] Inventor: Walter Kleiner, Hirzel-Zurich, Switzerland

[73] Assignee: Staeubli Ltd., Horgen-Zurich, Switzerland

[21] Appl. No.: 313,128

[22] Filed: Oct. 20, 1981

[30] Foreign Application Priority Data

Oct. 20, 1980 [CH] Switzerland ..... 7825/80

[51] Int. Cl.[3] ..... D03D 51/08

[52] U.S. Cl. ..... 139/1 E

[58] Field of Search ..... 139/1 E, 1 R, 66 R, 139/336; 192/0.09, 17, 48.91, 99 A

[56] References Cited

FOREIGN PATENT DOCUMENTS

| | | | |
|---|---|---|---|
| 2514248 | 9/1976 | Fed. Rep. of Germany | 139/1 E |
| 47-5463 | 2/1972 | Japan | 139/66 R |
| 444740 | 1/1949 | Italy | 139/1 E |
| 447700 | 5/1936 | United Kingdom | 139/66 R |
| 598983 | 2/1978 | U.S.S.R. | 139/1 E |

*Primary Examiner*—James Kee Chi

*Attorney, Agent, or Firm*—Flynn, Thiel, Boutell & Tanis

[57] ABSTRACT

A pick-finding mechanism is arranged between a weaving machine and a shed-forming machine. A sleeve of a gear sits rotatably on a shaft, which gear is driven by the weaving machine. A single-tooth coupling can transmit forces from the gear to a sliding sleeve which is secured by a key to the shaft and can be moved axially of the shaft by a switch lever. The shaft can be driven through a multiple-tooth coupling by a motor and a drive gear. The switch lever serves to couple and uncouple the couplings.

To find the pick, the single-tooth coupling is disengaged and the multi-tooth coupling is engaged. The weaving machine and dobby can be driven together in phase and in both directions by the motor at slow speed, by simultaneously engaging both couplings. This slow or creeping speed permits observation of the functioning and stopping of the machines in any desired position at any time.

9 Claims, 6 Drawing Figures

PICK-FINDING MECHANISM WITH CREEPING SPEED

CROSS-REFERENCE TO RELATED APPLICATION

This application is related to a co-pending application entitled "APPARATUS FOR COUPLING A WEAVING MACHINE AND SHED-FORMING MACHINE FOR EFFECTING PICK FINDING AND SLOW SPEED OPERATION", Ser. No. 313 127, filed concurrently herewith.

FIELD OF THE INVENTION

The invention relates to a pick-finding mechanism constructed as a creeping-speed drive for a weaving machine with a shed-forming machine connected thereto and, more particularly, to such a mechanism having a drive motor, a first coupling arrangement for selectively drivingly connecting the drive motor to the shed-forming machine, and a second coupling arrangement for selectively drivingly connecting the weaving machine drive to the shed-forming machine.

BACKGROUND OF THE INVENTION

The term creeping speed means a slow speed of a machine, wherein the functioning of the machine can be observed in slow motion and incorrect sequences can be determined. Also, the creeping speed is used to permit manually stopping the machine as it runs through a critical phase of operation. It is known in smaller machines to simulate the sequence of operations through a manual drive in the creeping speed. In the case of larger or heavier machines, for example weaving machines in which the heddle frames must be lifted, such a manual drive is no longer possible. Instead, the machine is equipped with a special motor for effecting the creeping speed. In weaving machines, a motor-driven creeping speed with forward and backward movement is desired. Thus, the machine can be observed during slow speed operation by a single person over the entire machine width, which is not possible in the case of a manual drive.

It was previously known to equip such a weaving machine with a separate creeping-speed transmission, which usually consists of a small auxiliary motor and a reduction gearing. Operation of the auxiliary motor, for safety reasons, occurs only when the main motor for the weaving machine is switched off. During the weaving process, it is not possible for the transmission and the motor to rotate along freely.

Such a creeping speed transmission could also be used basically for the pick finding in weaving machines. However, it is disadvantageous to have to also drive the entire weaving machine during such a pick finding. Also, not all weaving machines can be driven backwardly. In addition, driving the entire weaving machine in this manner can have disadvantageous effects on threads and fabrics.

A purpose of the invention is therefore to provide a motor-driven mechanism for a weaving machine which makes it possible to permit the weaving machine having a connected shed-forming machine to run without any large extra expenditure at a slow or creeping speed for the purpose of observation and for taking any necessary corrective measures.

SUMMARY OF THE INVENTION

This is achieved with a mechanism of the above-mentioned type, which is characterized inventively by means for moving the two couplings into simultaneous engagement.

This makes it possible for the weaving machine and the shed-forming machine to run with a creeping speed with only small constructive changes of a mechanism which is known in the art of dobby building, like the motor-driven pick finder, which is a great step forward in the weaving technique.

It is possible with the inventive mechanism, without any great extra expenditure and by means of a pick finder with a separate motor which is arranged between a weaving and a shed-forming machine, to rotate both such machines simultaneously, in phase and in two directions.

A preferred embodiment of the pick finder is equipped with a two-stage switch mechanism, whereby with one switching the creeping-speed gearing transmission is simultaneously coupled with the weaving and the shed-forming machine, while with the other switching the gearing is coupled only to the shed-forming machine and simultaneously becomes disengaged from the shed-forming machine of the weaving machine through a coupling which is engaged only in one single position.

A modification consists in the weaving machine being coupled temporarily, while carrying out a pseudo-pick-finding operation, with the shed-forming machine which is equipped with a pick finder, whereby measures are taken so that both machines rotate in phase.

In place of a two-stage switch mechanism a conventional pick finder can be equipped with two couplings which, during pick finding, are both disengaged on the side of the weaving machine and are engaged on the motor side, while during creeping-speed operation the weaving mechanism remains coupled in on the machine side and is coupled in on the motor side.

BRIEF DESCRIPTION OF THE DRAWINGS

Exemplary embodiments of the inventive pick-finding mechanism are illustrated in the drawings, in which.

DETAILED DESCRIPTION

Figure 1:
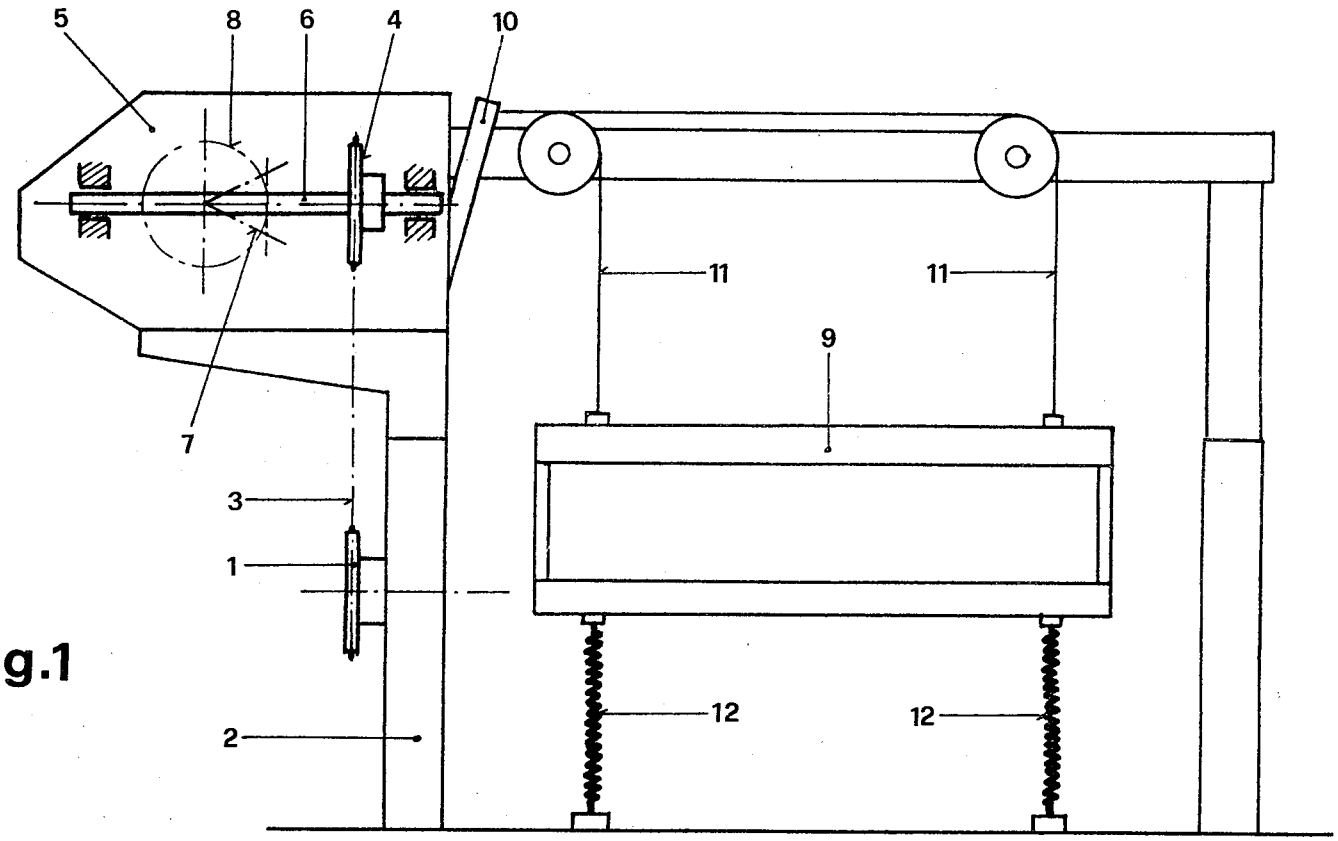
FIG. 1 is an elevational side view illustrating a weaving machine with an attached shed-forming machine.

FIG. 1 illustrates a weaving machine 2, onto which is mounted a shed-forming machine or dobby 5. The dobby 5 is driven by a sprocket wheel 1 on the drive shaft of the weaving machine, a chain 3 which is indicated in broken lines, and a sprocket wheel 4 which is rotatably supported on a shaft 6 of the dobby. The drive shaft of the weaving machine is driven by a not illustrated drive motor. The sprocket wheel 4 drives the shaft 6 and two bevel gears 7 and 8 of the dobby which are indicated in broken lines through a coupling which is not illustrated in FIG. 1 but is described hereinafter in association with FIGS. 2-6. A heddle frame 9 of the weaving machine is pulled up against the force of release springs 12 in a conventional manner by a member 10 and the actuating cables 11 of the heddle dobby 5.

Figure 2:
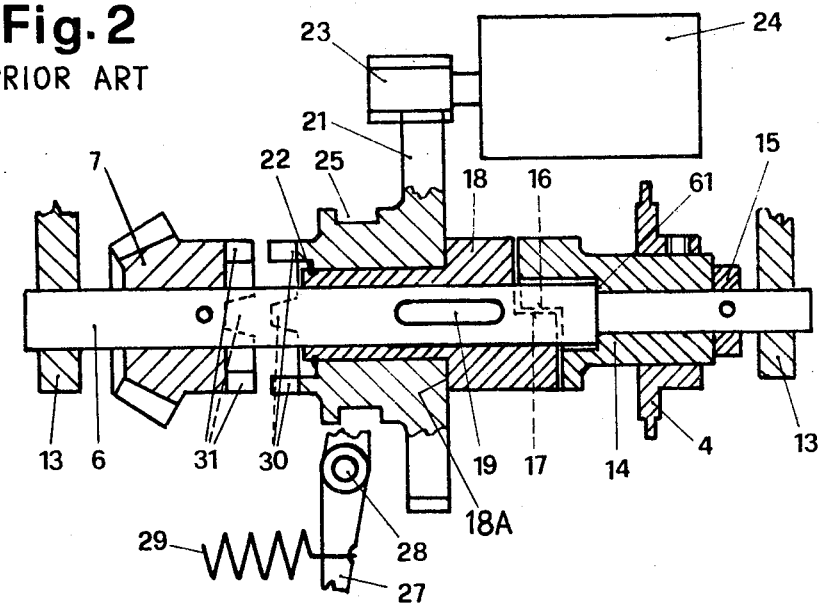
Fig. 2 PRIOR ART
FIG. 2 is a longitudinal sectional side view of a conventional pick-finding mechanism in a "weaving" position.
Figure 3:
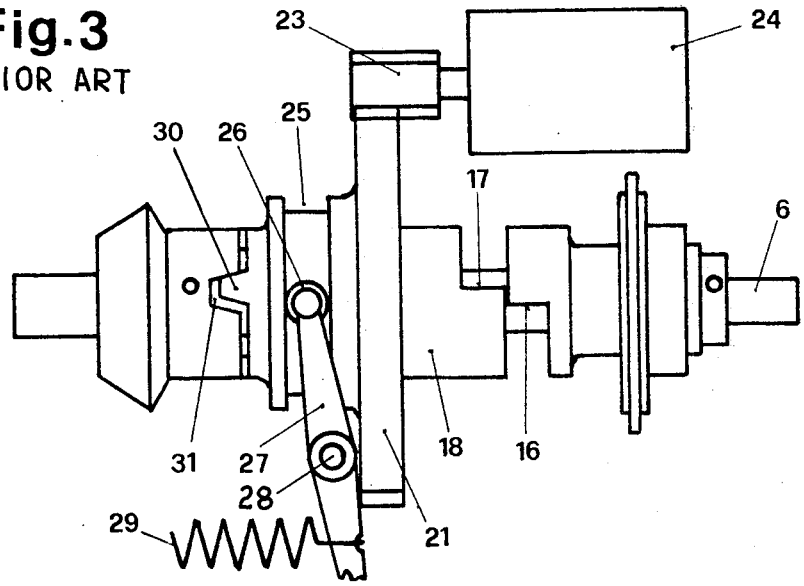
Fig. 3 PRIOR ART
FIG. 3 is an elevational side view of the pick-finding mechanism of FIG. 2 in a "pick-finding" position.

A conventional pick finder, illustrated in FIGS. 2 and 3, is typically set up on the shaft 6 which is rotatably supported in a conventional manner in the sidewalls or shields 13 of the dobby. It consists of the drive element or sprocket wheel 4, which is driven by the weaving machine as described above and is fixedly secured on a carrier sleeve 14, one side of which has a single tooth or claw 16 which is part of a single-tooth coupling. The sleeve 14 is rotatably supported on the shaft 6 and is secured against movement axially of the shaft 6 by a shoulder 61 on the shaft 6 and the adjusting ring 15 which is secured on the shaft 6.

A tooth 17 on an axially movable sliding sleeve or element 18 supported on the shaft 6 cooperates with the tooth 16, which sliding sleeve 18 is fixed against rotation relative to the shaft by the key 19. The sliding sleeve 18 in turn supports a gear 21, which is operatively connected to the pinion gear 23 of an auxiliary motor 24 which powers the pick finder. The gear 21 is supported freely rotatably on the sleeve 18 and is fixed against axial movement relative thereto by a retaining ring 22 and an axially facing shoulder 18A on the sleeve 18. The gear 21 has on one side a plurality of teeth 30 which are designed to engage the gaps 31 between plural teeth provided on the drive element or bevel gear 7 which is fixedly secured on the shaft 6.

The sliding sleeve 18 can, with the gear 21 which is supported on it, be moved back and forth between end positions of engagement with the carrier sleeve 14 and with the bevel gear 7. The single-tooth coupling 16 and 17 and the multiple-tooth coupling 30 and 31 are each completely engaged or released at the respective end positions. Both of the couplings are engaged in the inbetween position.

The carrier sleeve 18 is moved with the help of a fork-shaped switch lever 27 which is pivotally supported on an axle 28 which is stationarily fixed. The hub of the gear 21 is disposed between the arms of the lever 27. A roller 26 is provided on each of the arms of the fork-shaped part of the switch lever 27 and rolls within an annular groove 25 provided in the gear 21. A relatively strong return spring 29 acts onto the switch lever 27, urging the gear 21 rightwardly in FIG. 1 so that the single-tooth coupling 16 and 17 re-engages within the shortest possible time.

FIG. 2 illustrates the pick finder in the basic "weaving" position, namely during the weaving process of the weaving machine. The single-tooth coupling is engaged and the pick-finding motor 24 is switched off. The dobby 5 is driven by the gear 4 through the carrier sleeve 14, the engaged single-tooth coupling 16 and 17, the sliding sleeve 18, the key 19, the shaft 6, and the bevel gear 7. This position is maintained by the tensioned spring 29.

When the weaving machine is stopped, the switch lever 27 can be pivoted by the machine operator against the force of the return spring 29 from the position according to FIG. 2 into the position according to FIG. 3, by which act the return spring 29 becomes more strongly tensioned. Through this pivoting of the switch lever 27, the sliding sleeve 18 is moved to the position illustrated in FIG. 3. The dobby 5 is released from driving engagement with the weaving machine by the disengagement of the single-tooth coupling 16 and 17. The weaving machine is, as mentioned, stopped. The pick-finding motor 24 can then be switched on. It drives, through the pinion gear 23, the gear 21, the multi-tooth coupling 30 and 31, and the bevel gear 7, the dobby mechanism which is conventional and not illustrated in detail.

Thus, the switch lever 27 is switchable between two positions in the previously known modes of operation, namely, the "weaving" position of FIG. 2 and the "pick-finding" position of FIG. 3. The motor 24 has, in FIG. 3, already driven the gear 21 rotationally for a small distance relative to the sleeve 14.

Figure 4:
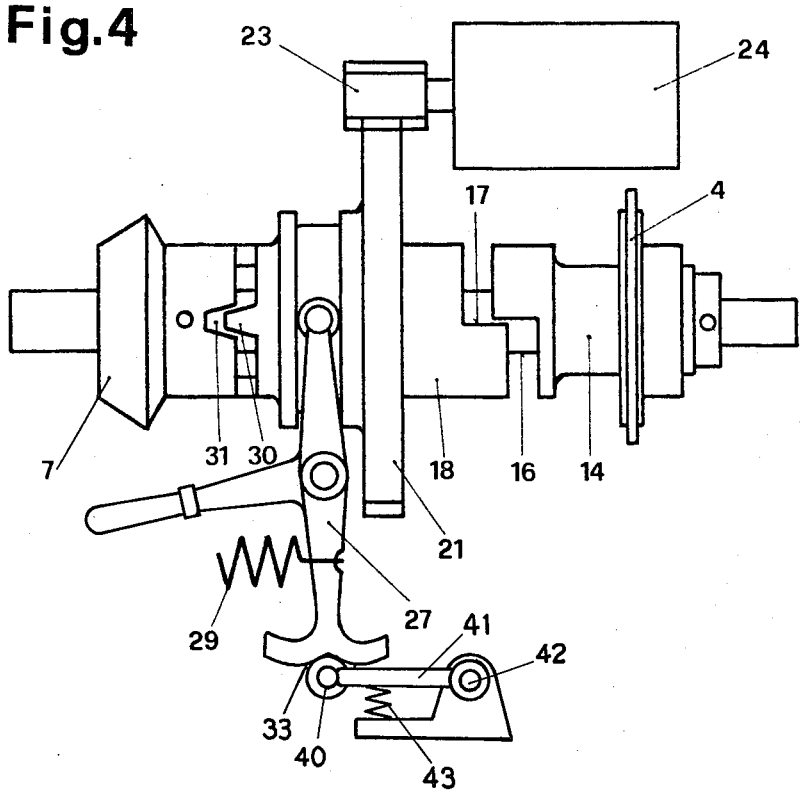
FIG. 4 is an elevational side view illustrating a pick finder embodying the present invention in a "creeping-speed" position.

What is novel here is that, as is illustrated in FIG. 4, the switch lever 27 can be locked by a retaining mechanism in a position intermediate the known end positions, i.e. by pivoting the switch lever 27 from one extreme position at the left hand side—according to Fig. 2—to the extreme position at the right hand side—according to FIG. 3—the roller 40 clicks into the groove 33 on the bottom of the switch lever 27, so that the switch lever is locked in the intermediate position. The roller 40 is supported by the arm 41, which is pivotally mounted on the fixed pin 42. The roller 40 is forced into the groove 33 by the force of the compression spring 43. When the switch lever 27 is in its intermediate position, the sliding sleeve 18 with the gear 21 mounted thereon is also in the intermediate position corresponding the intermediate position in FIG. 4, wherein both the single-tooth coupling 16 and 17 and also the multi-tooth coupling 30 and 31 are engaged. When the weaving machine drive motor is switched off and the brake of the weaving machine is released, it is then possible to switch on the motor 24 of the pick finder. It then drives at a creeping speed, through the pinion gear 23, multi-tooth coupling 30 and 31, and bevel gear 7, the dobby, and through the bevel gear 7 the shaft 6, sleeve 18, single-tooth coupling 16 and 17, carrier sleeve 14, sprocket wheel 4 and chain 3 (FIG. 1), the weaving machine.

By switching the motor 24 of the pick finder on and off, it is possible to observe the weaving machine 2 and the dobby 5 operating at slow speed or to stop it, so long as the switch lever 27 is maintained in the center position.

Figure 5:
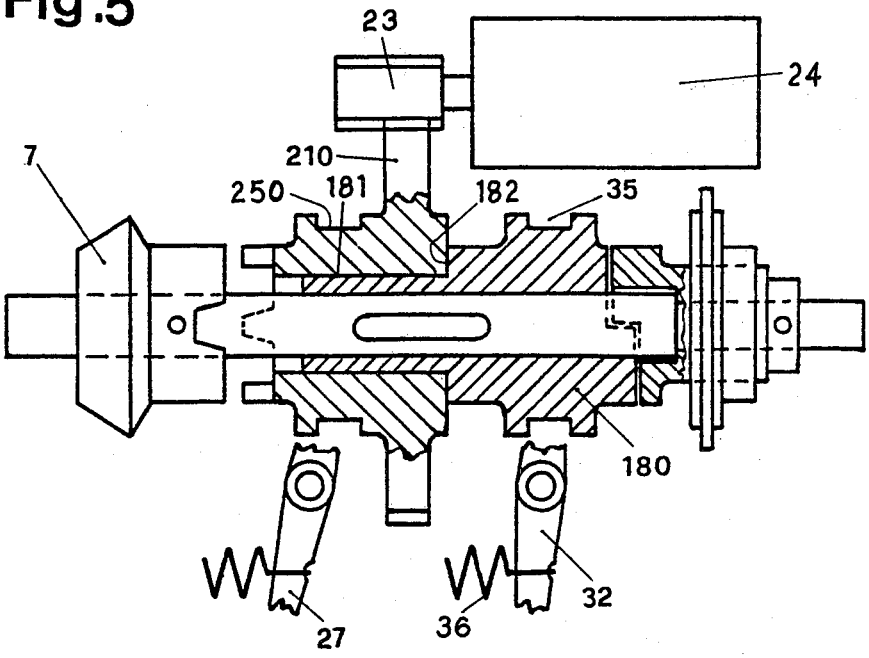
FIG. 5 is a longitudinal sectional side view of a pick-finding mechanism embodying the present invention in a "weaving" position.
Figure 6:
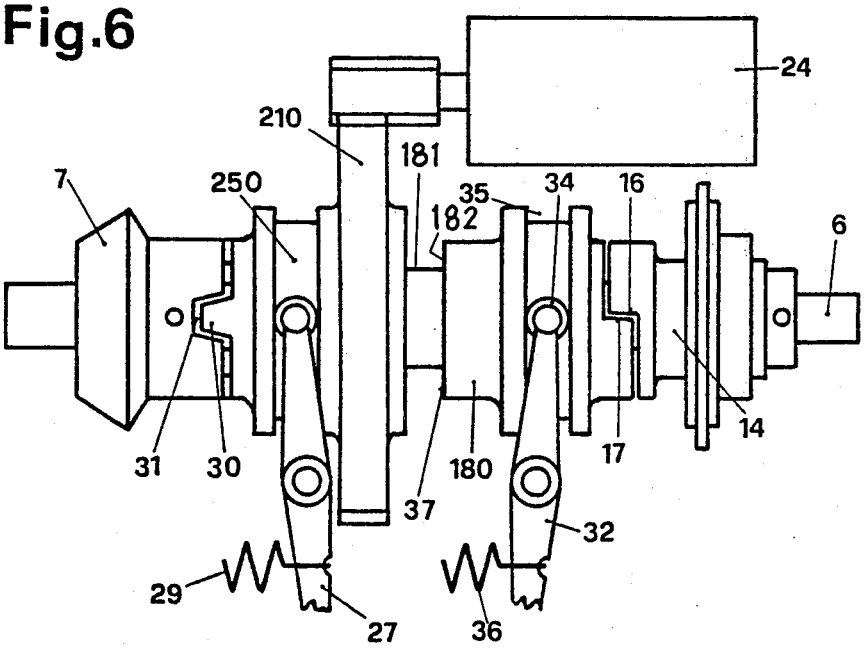
FIG. 6 is an elevational side view of the pick-finding mechanism of FIG. 5 in a "creeping-speed" position.

FIGS. 5 and 6 illustrate an alternative pick-finding mechanism embodying the present invention, in which two pivotally supported switch levers 27 and 32 are provided, each of which can be switched between only two positions. The lever 32 is also supported on a stationary axis. With this, the uncertainty which exists through the possibility of switching between three positions, as in FIG. 4, is avoided.

The pick finder of FIGS. 5 and 6 differs from the already described pick finder in that a gear 210 is axially slidably supported on a cylindrical surface 181 of the sliding sleeve 180. During axial movement of the gear 210 by means of the switch lever 27 which engages the groove 250, the multi-tooth coupling 30 and 31 becomes engaged. The sliding sleeve 180 remains in its normal position and is moved only when the second switch lever 32 which engages the groove 35 of the sliding sleeve 180 is operated. The switch lever 32, which is under the action of a return spring 36, is also fork-shaped, and has a roller 34 on the end of each arm.

When the creeping speed which is effected by the motor 24 is to be switched on, the switch lever 27 is pivoted to the position illustrated in FIG. 6. The switch lever 32 remains unoperated. In this manner, the coupling 30 and 31 is engaged and couples gear 210 and bevel gear 7, and the single-tooth coupling 16 and 17 remains coupled in without change. The motor 24 of the pick finder thus drives both the dobby 5 and also the weaving machine 2. However, a not illustrated safety system which is not part of the present invention takes care that the switch lever 27 can only be operated when the weaving machine is stopped.

Alternatively, the switch lever 32 is pivoted for pick finding. With this, the sliding sleeve 180 moves to the left and, due to an annular shoulder 182 thereon, moves the gear 210 simultaneously to the left. The single-tooth coupling 16 and 17 is thereby released and, at the same time, the gear 210 is moved to the left, so that the multi-tooth coupling becomes engaged. During pick finding, the motor 24 drives only the dobby, and the weaving machine is stopped. The springs 29 and 36, at the end of the pick-finding process, urge the respective switch levers 27 and 32 approximately simultaneously back into the basic position according to FIG. 5. With this, the current to the auxiliary motor 24 is also interrupted.

The embodiment according to FIGS. 5 and 6 has various advantages with respect to the one according to FIG. 4. A clear function separation exists, due to the presence of the two switch levers 27 and 32. A center position of a lever does not need to be maintained. The spring 36 may be substantially weaker than the spring 29, because both act together to provide the relatively large return force at the end of the pick-finding operation which urges the teeth 16 and 17 to again engage one another. The control distances can be adjusted individually in order to suit particular conditions. It is alternatively possible to use friction couplings. The coupling is simpler to handle and is fool-proof.

Although preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a method of operating a pick-finding mechanism which is operatively coupled to a motor and to a weaving machine having a dobby and which includes first coupling means for selectively operatively coupling said weaving machine and said dobby and second coupling means for selectively operatively coupling said motor and said dobby, including the step of respectively engaging and disengaging said first and second coupling means so that said weaving machine is operatively coupled to and drives said dobby and the step of respectively engaging and disengaging said second and first coupling means so that said motor is operatively coupled to and drives said dobby, the improvement comprising the step of simultaneously engaging said first coupling means and said second coupling means so that said motor is operatively coupled to and drives both said weaving machine and said dobby.

2. A pick-finding mechanism for a weaving machine having a dobby, comprising a shaft supported for rotation about a first axis, a first element fixedly secured to said shaft and operatively coupled to said dobby, a second element supported on said shaft at a location spaced from said first element for rotation about said first axis independently of said shaft, said second element being fixed against axial movement with respect to said shaft and being operatively coupled to said weaving machine, a third element axially slidably supported on said shaft between said first and second elements and fixed against rotation relative to said shaft, said third element being axially movable with respect to said shaft between first and second positions, a fourth element supported on said third element for rotation relative to said third element and said shaft about said first axis, said fourth element being movable relative to said shaft between third and fourth positions, a motor which is operatively coupled to said fourth element and effects rotation first and fourth elements when said fourth element is in said third position, and second coupling means for operatively coupling said second and third elements when said third element is in said second position, said first and second coupling means respectively being disengaged when said fourth and third elements are respectively in said fourth and first positions, and retaining means for maintaining said third and fourth elements in fifth and sixth positions, respectively, in which said first and second coupling means are both operatively engaged.

3. The mechanism according to claim 2, wherein said fourth element is fixed against axial movement relative to said third element and is in said third, fourth and sixth positions when said third element is in said first, second and fifth positions, respectively, said fifth and sixth positions respectively being between said first and third positions and said third and fourth positions.

4. The mechanism according to claim 3, wherein said retaining means includes means defining a circumferential first groove on said fourth element, a first lever supported for pivotal movement about a second axis and having an end remote from said second axis disposed in said first groove, means defining a second groove on said first lever at a location spaced from said second axis, a roller which is supported rotatably and for movement toward and away from said groove in said lever, and resilient means for yeildably urging said roller toward said second groove.

5. The mechanism according to claim 4, including a second lever which is supported at one end for pivotal movement about a third axis and has said roller pivotally supported thereon at a location remote from said third axis, and wherein said resilient means includes a spring cooperable with said second lever for urging pivotal movement of said second lever about said third axis in a direction which urges said roller toward said second groove.

6. The mechanism according to claim 5, including further resilient means cooperable with said first lever for urging pivotal movement of said first lever in a direction corresponding to axial movement of said fourth element toward said fourth position.

7. The mechanism according to claim 2, wherein said fourth element is axially movable relative to said third element, said fifth position is said first position, and said sixth position is said fourth position.

8. The mechanism according to claim 7, wherein said retaining means includes means defining a respective circumferential groove on each of said third and fourth elements, and first and second levers supported for pivotal movement about respective pivot axes, each said lever having a roller rotatably supported thereon at a location spaced from said pivot axis thereof, and each said roller being received in a respective one of said circumferential grooves, pivotal movement of said levers effecting axial movement of said third and fourth elements.

9. A pick-finding mechanism for a weaving machine having a dobby, comprising a rotatably supported shaft, a first gear fixedly secured on said shaft and drivingly coupled to said dobby, a second gear rotatably supported on and fixed against axial movement with respect to said shaft at a location spaced from said first gear, a sleeve axially slidably supported on and fixed against rotation with respect to said shaft at a location between said first and second gears, a third gear supported on said sleeve for rotation about said axis relative to said sleeve and fixed against axial movement relative to said sleeve, said sleeve and third gear being axially movable with respect to said shaft between first and second positions, a motor having a pinion on the shaft thereof which drivingly engages the teeth of said third gear, first coupling means for operatively coupling said first gear and said third gear when said third gear is in said first position, including at least one tooth on each of said first gear and third gear which engage each other when said third gear is in said first position and are free of engagement with each other when said third gear is in said second position, second coupling means for operatively coupling said second gear and sleeve when said sleeve is in said second position, including at least one tooth on each of said second gear and said sleeve which operatively engage each other when said third gear is in said second position and are free of engagement when said third gear is in said first position, means defining a circumferential first groove on said third gear, a first lever supported for pivotal movement about an axis and having a first roller rotatably supported thereon at a location spaced from said axis, said first roller being received in said first groove in said third gear and pivotal movement of said first lever between third and fourth positions effecting axial movement of said third gear and said sleeve between said first and second positions, first resilient means cooperable with said first lever for urging it toward said third position, said first lever thereby urging said third gear and said sleeve toward said first position, and retaining means for respectively holding said first lever and said third gear and sleeve in fifth and sixth positions which are respectively intermediate said first and second positions and said third and fourth positions, said first coupling means and said second coupling means being simultaneously engaged when said third gear and sleeve are in said sixth position, said retaining means including means defining a second groove on said first lever, a second lever which is pivotally supported at one end and has a second roller rotatably supported at its other end, said second roller being engageable with said second groove, and second resilient means cooperable with said second lever for urging said second roller into engagement with said second groove.

* * * * *

UNITED STATES PATENT AND TRADEMARK OFFICE

CERTIFICATE OF CORRECTION

PATENT NO. : 4 428 404

DATED : January 31, 1984

INVENTOR(S) : Walter KLEINER

It is certified that error appears in the above-identified patent and that said Letters Patent is hereby corrected as shown below:

Col. 6, line 15; after "rotation" insert ---thereof, first coupling means for operatively coupling said---.

Col. 6, line 16; delete "and".

Col. 6, line 42; change "yeildably" to ---yieldably---.

Col. 6, line 60; change "first" to ---second---.

Col. 6, line 61; change "fourth" to ---third---.

Col. 8, line 12; change "third" to ---fourth---.

Col. 8, line 14; change "first" to ---second---.

Signed and Sealed this

*Fifteenth* Day of *May 1984*

[SEAL]

*Attest:*

GERALD J. MOSSINGHOFF

*Attesting Officer*

*Commissioner of Patents and Trademarks*